US007049927B1

(12) United States Patent
Hasegawa

(10) Patent No.: US 7,049,927 B1
(45) Date of Patent: May 23, 2006

(54) RESISTANCE SUBSTRATE AND VARIABLE RESISTOR

(75) Inventor: Naotake Hasegawa, Sabae (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/103,166

(22) Filed: Apr. 11, 2005

(51) Int. Cl.
*H01C 10/30* (2006.01)

(52) U.S. Cl. ..... 338/160; 338/162; 338/309

(58) Field of Classification Search ..... 338/162, 338/163, 174, 185, 188, 160, 309
See application file for complete search history.

(56) References Cited

U.S. PATENT DOCUMENTS

| | | | | |
|---|---|---|---|---|
| 3,206,702 | A * | 9/1965 | Greenwood | 338/162 |
| 4,213,113 | A * | 7/1980 | Brandt et al. | 338/309 |
| 4,429,297 | A * | 1/1984 | Nakatsu | 338/162 |
| 5,525,956 | A * | 6/1996 | Hashizume et al. | 338/162 |
| 5,847,640 | A * | 12/1998 | Fukaya et al. | 328/160 |
| 6,078,248 | A * | 6/2000 | Yagi | 338/174 |
| 6,628,193 | B1 * | 9/2003 | Doi et al. | 338/162 |
| 2002/0163417 | A1 * | 11/2002 | Masuda et al. | 338/162 |

FOREIGN PATENT DOCUMENTS

| | | |
|---|---|---|
| JP | 2003-124009 | 4/2003 |

* cited by examiner

*Primary Examiner*—Tu Hoang
(74) *Attorney, Agent, or Firm*—Keating & Bennett, LLP

(57) ABSTRACT

A resistance substrate includes a substrate member, two conductive elements provided on the substrate member, and a resistor element provided on the substrate member, the resistor element electrically connecting the conductive elements to each other. Each of the conductive elements includes an exposed portion of a metal terminal and an electrode film, the exposed portion of the metal terminal being exposed on a surface of the substrate member and the electrode film being electrically connected to the exposed portion and extending along a direction in which the resistor element extends. Each of the conductive elements is covered by an insulator film such that an exposed portion of the electrode film is left uncovered. The resistor element is electrically connected to the exposed portions of the electrode films at both ends thereof.

13 Claims, 9 Drawing Sheets

RESISTANCE SUBSTRATE AND VARIABLE RESISTOR

BACKGROUND OF THE INVENTION

1. Field of the Invention

The present invention relates to resistance substrates and variable resistors, and more specifically, to a resistance substrate having a variable resistance between two conductive elements and a variable resistor including a slider which slides along a resistor element provided on a substrate member to adjust a resistance.

2. Description of the Related Art

A rotary variable resistor including a slider which slides along a resistor element to adjust a resistance is disclosed in Japanese Unexamined Patent Application Publication No. 2003-124009. FIG. 8 shows a manufacturing step of this variable resistor, in which a substrate member 10 is formed on a hoop material 40 by resin molding, the hoop material 40 being formed into a shape corresponding to terminals by a punching process. FIG. 9 shows a state in which a substantially annular resistor element 15 is formed on the substrate member 10 and metal terminals 12 and 13 are separated from the hoop material 40.

The terminal 12 includes terminal portions 12*a* and an annular current collector 12*b*, and the current collector 12*b* is exposed on the surface of the substrate member 10. In addition, a pair of terminals 13 includes terminal portions 13*a* and end portions 13*b*, and the end portions 13*b* are exposed on the surface of the substrate member 10. The current collector 12*b* and the resistor element 15 are concentric with respect to each other, and a slider (not shown) slides along the current collector 12*b* and the resistor element 15, such that a resistance between the terminals 12 and 13 is adjusted depending upon the rotation angle of the slider.

The resistance obtained when the slider is rotated to a maximum rotation angle is proportional to the length of the resistor element 15 between the end portions 13*b*, and a variable resistance range corresponds to the length of the resistor element 15 excluding an area corresponding to an angle Y between the end portions 13*b*. The angle Y refers to a maximum angle between lines extending from the center of the resistor element 15 through the end portions 13*b*. That is, an angle between lines extending through the outermost positions of the end portions 13*b*.

In this variable resistor, the pair of terminals 13 are obtained by forming the hoop material 40 into a corresponding shape by the punching process using a mold. Therefore, when various types of variable resistors having different variable resistance ranges are to be manufactured, the same number molds as the number of types of variable resistors must be provided to form the end portions 13*b* at different positions (that is, to obtain different angles Y). However, this is not practical since it is difficult, time consuming and expensive to design and produce multiple types of molds. This problem is not limited to rotary variable resistors, and variable resistors having linearly-moving sliders also have a similar problem.

In addition, in rotary variable resistors, it is necessary to arrange the end portions 13*b* as close as possible to each other (that is, to make the angle Y as small as possible) to increase the variable resistance range. However, since the terminal 12 having the current collector 12*b* integrated therewith is located between the terminals 13, the terminal 12 prevents the end portions 13*b* from being arranged very close to each other. Therefore, there is a limit on the amount that the variable resistance range can be increased.

SUMMARY OF THE INVENTION

To overcome the problems described above, preferred embodiments of the present invention provide a resistance substrate and a variable resistor having a structure such that a variable resistance range can be increased and can be easily varied.

A resistance substrate according to a preferred embodiment of the present invention includes a substrate member, two conductive elements provided on the substrate member, and a resistor element provided on the substrate member, the resistor element electrically connecting the conductive elements to each other. Each of the conductive elements includes an exposed portion of a metal terminal and an electrode, the exposed portion of the metal terminal being exposed on a surface of the substrate member and the electrode being electrically connected to the exposed portion and extending along a direction in which the resistor element extends. Each of the conductive elements is covered by an insulator film such that an exposed portion of the electrode is left uncovered. The resistor element is electrically connected to the exposed portions of the electrodes at both ends thereof.

In the resistance substrate according to a preferred embodiment of the present invention, the exposed portions of the two electrodes which are not covered by the insulator film are electrically connected to each other via the resistor element. Accordingly, a variable resistance range can be increased by simply changing the locations of the exposed portions, that is, by changing the location at which the insulator film for covering the conductive elements is formed. In addition, the variable resistance range can be varied. Accordingly, unlike the known structure, it is not necessary to form the terminals by a punching process using various types of molds, and various types of resistance substrates and variable resistors having different variable resistance ranges are easily manufactured.

In addition, according to a preferred embodiment of the present invention, a variable resistor includes the above-described resistance substrate and a slider slidable along a surface of the resistor element. The resistor element preferably has a substantially annular shape with a cutout portion. With this structure, rotary variable resistors in which resistances are adjusted depending on the rotational locations of sliders and which have increased or different variable resistance ranges can be easily manufactured.

In addition, a maximum angle between lines extending from the center of the resistor element through the exposed portions of the electrodes may be set to be less than a maximum angle between lines extending from the center of the resistor element through the exposed portions of the metal terminals in a region including the cutout portion. With this structure, the length of the substantially annular resistor element can be increased without changing the shapes and locations of the metal terminals. Accordingly, the variable resistance range can be increased.

These and other features, elements, characteristics and advantages of the present invention will become more apparent from the following detailed description of preferred embodiments of the present invention with reference to the attached drawings.

DETAILED DESCRIPTION OF PREFERRED EMBODIMENTS

Variable resistors according to preferred embodiments of the present invention will be described below with reference to the accompanying drawings.

First Preferred Embodiment

Figure 1:
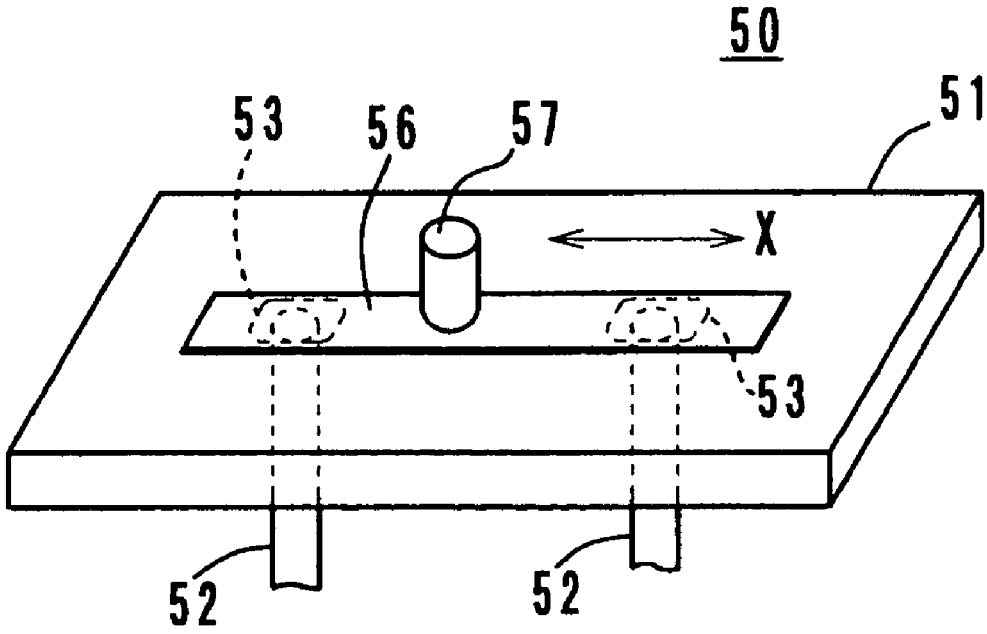
FIG. 1 is a perspective view showing a resistance substrate according to a preferred first preferred embodiment of the present invention.
Figure 2A:
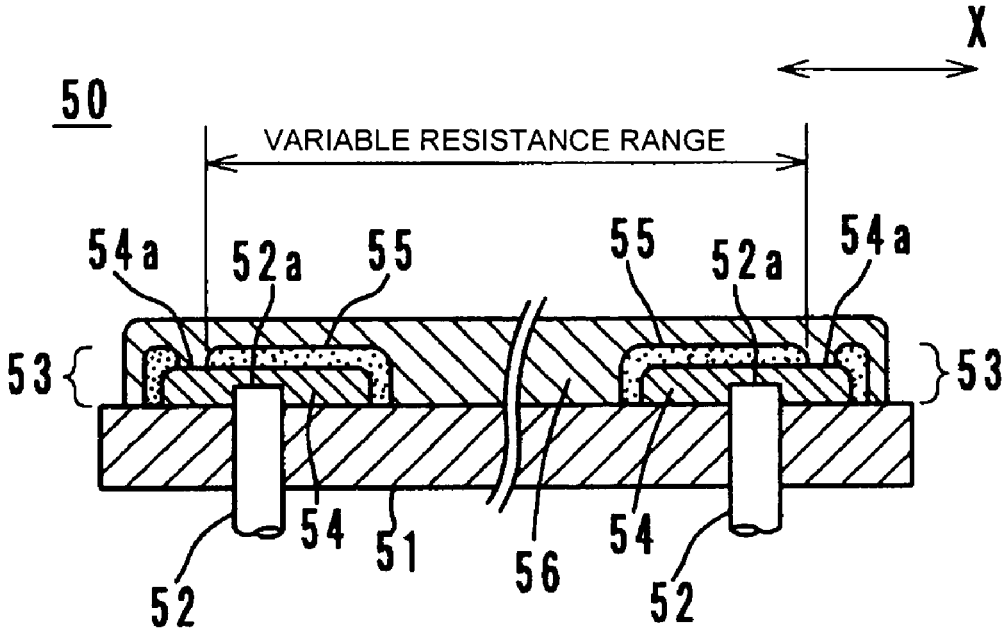
FIG. 2A is sectional view of the resistance substrate in which a maximum resistance is relatively high.
Figure 2B:
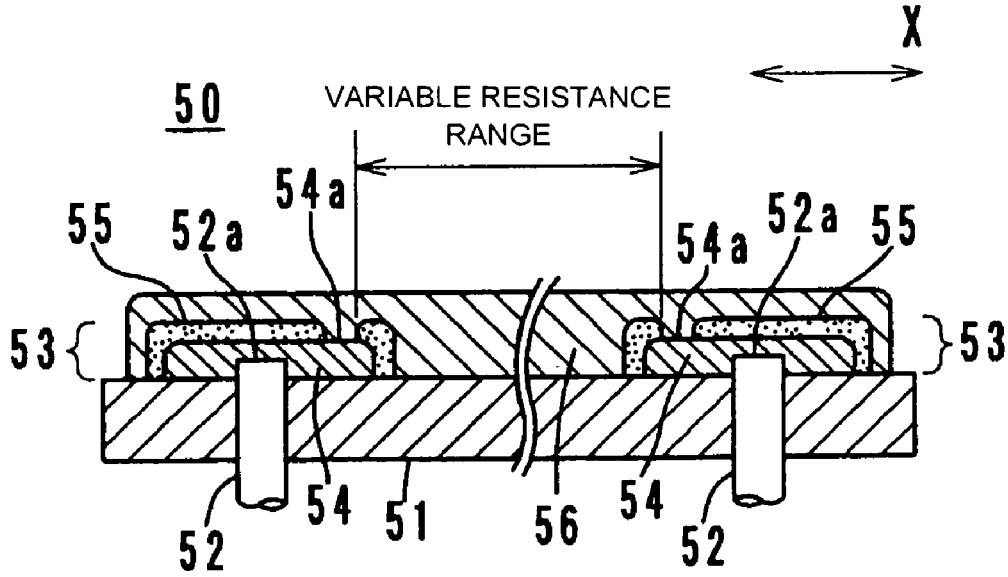
FIG. 2B is sectional view of the resistance substrate in which a maximum resistance is relatively low.

A resistance substrate according to a first preferred embodiment of the present invention will be described below with reference to FIGS. 1, 2A, and 2B.

A resistance substrate 50 includes a substrate member 51 made of insulating material, two conductive metal terminals 52, two conductive elements 53, and a resistor element 56.

Each metal terminal 52 includes an exposed portion 52*a* at the top, the exposed portion 52*a* being exposed on a surface of the substrate member 51. Each conductive element 53 includes the exposed portion 52*a* of the corresponding metal terminal 52 and an electrode film 54 which is electrically connected to the exposed portion 52*a* and which extends along a direction X in which the resistor element 56 extends. Each electrode film 54 is covered by an insulator film 55 such that an exposed portion 54*a* of the electrode film 54 is left uncovered.

The resistor element 56 is obtained by applying a conductive resin material to the surface of the substrate member 51, and extends so as to cover the conductive elements 53 at both ends thereof. The resistor element 56 is electrically connected to the exposed portions 54*a* of the electrode films 54, and is thereby electrically connected to the metal terminals 52 via the electrode films 54.

In the resistance substrate 50, a slider 57 slides along the resistor element 56 in the direction shown by arrow X, and a resistance between the slider 57 and the metal terminals 52 can be adjusted depending on the location at which the slider 57 stops. A variable resistance range corresponds to a gap between contact locations at which end portions the resistor element 56 are in contact with the exposed portions 54*a* of the corresponding electrode films 54. As shown in FIG. 2A, the variable resistance range is increased when the exposed portions 54*a* are located near outer ends in the direction (shown by arrow X) in which the resistor element 56 extends. In addition, as shown in FIG. 2B, the variable resistance range is reduced when the exposed portions 54*a* are located near inner ends in the direction (shown by arrow X) in which the resistor element 56 extends.

More specifically, in the first preferred embodiment, the variable resistance range can be varied without changing the locations and shapes of the metal terminals 52, by simply changing the locations of the exposed portions 54*a*, with which the end portions of the resistor element 56 come into contact, in the process of forming the insulator films 55.

The electrode films 54 may be formed of, for example, phenolic or epoxy thermosetting resin material including conductive material such as silver-based material and carbon-based material. In addition, the insulator films 55 may be formed of, for example, phenolic or epoxy thermosetting resin material. However, the present invention is not limited to this. The resistor element 56 and other components are made of materials similar to those used in the known structure.

Second Preferred Embodiment

A rotary variable resistor according to a second preferred embodiment of the present invention will be described below with reference to FIGS. 3A to 7C.

Figure 3A:
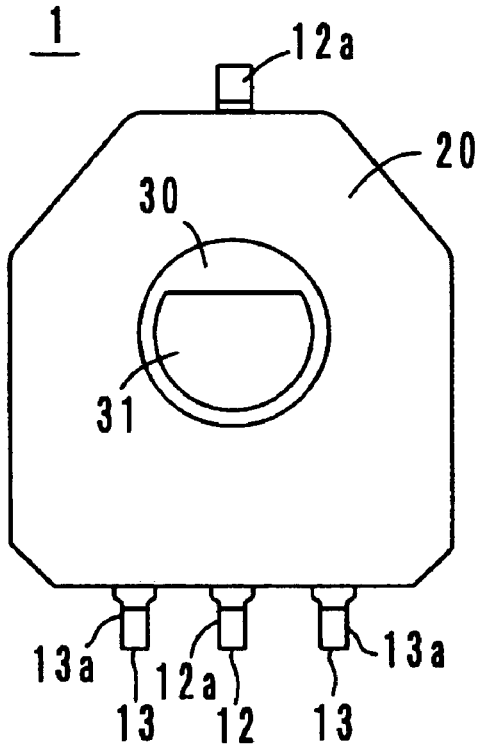
FIG. 3A is a plan view showing a variable resistor according to a second preferred embodiment of the present invention.
Figure 3B:
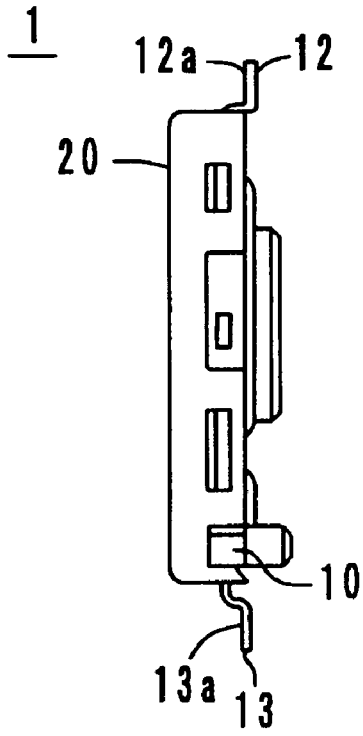
FIG. 3B is a side view of the variable resistor.
Figure 4:
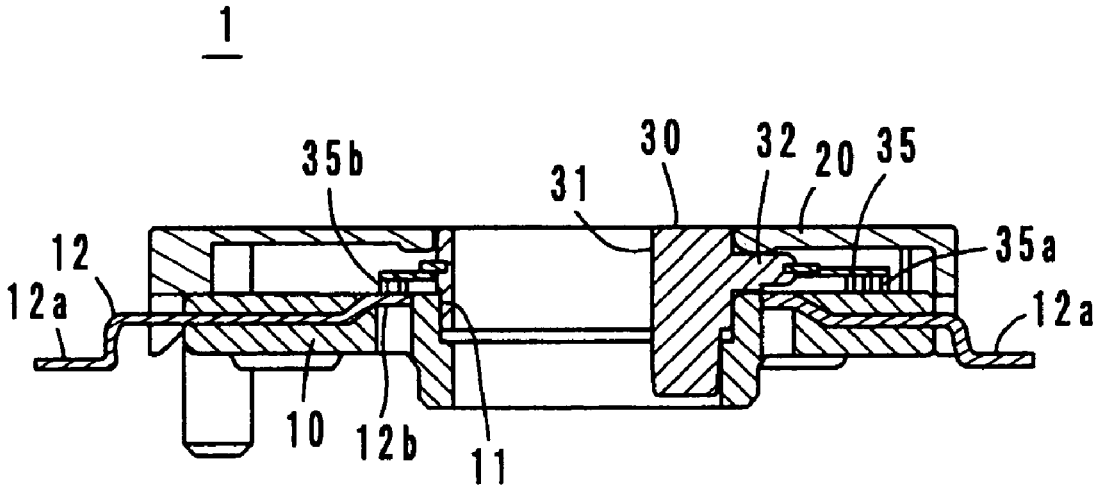
FIG. 4 is a sectional view of the variable resistor.

As shown in FIGS. 3A, 3B, and 4, a variable resistor 1 includes a substrate member 10, a cover 20, and a rotating shaft 30 having a slider 35, all of which are preferably formed as molded resin components. The substrate member 10 includes a center hole 11, and a first terminal 12 and second terminals 13 are embedded in the substrate member 10.

The first terminal 12 includes terminal portions 12*a* projecting from side surfaces of the substrate member 10 and an annular current collector 12*b* in the central area. The current collector 12*b* is exposed on the surface of the substrate member 10. The first terminal 12 including the end portions 12*a* and the current collector 12*b* is obtained by cutting the first terminal 12 out of a single metal member. Each of the second terminals 13 includes a terminal portion 13*a* which projects from a surface of the substrate member 10 at one end and an exposed portion 13*b* which is exposed on the surface of the substrate member 10 at the other end (see FIG. 7A).

Figure 7A:
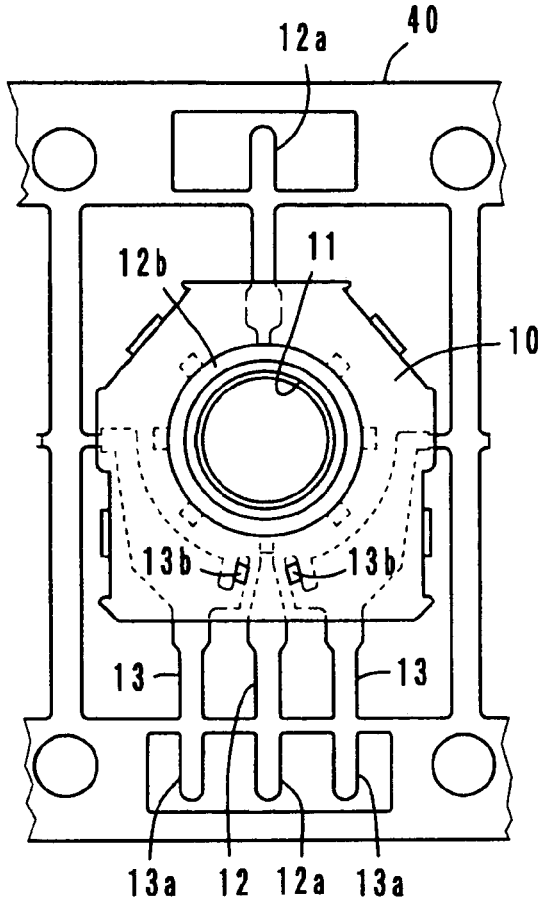
FIG. 7A is a diagram showing a substrate-molding step in a manufacturing process of the variable resistor.

As shown in FIG. 7A, the terminals 12 and 13 are obtained by forming a long hoop material 40 into a predetermined shape by a punching process, and the substrate member 10 is formed by resin molding using a mold (not shown). After resin molding, a substantially annular resistor element 15 is formed on the surface of the substrate member 10 by applying conductive resin material. The resistor element 15 includes end portions 15*a* which face each other, the end portions 15*a* being electrically connected to the exposed portions 13*b* of the terminals 13 via conductive elements 43 which will be described below. The current collector 12*b* and the resistor element 15 are formed concentrically with respect to each other on the surface of the substrate member 10, the current collector 12*b* being arranged inside the resistor element 15.

The rotating shaft 30 includes a center hole 31 and a flange 32 around which the slider 35 is attached, and is rotatably disposed in the center hole 11 of the substrate member 10. The slider 35 is made of conductive metal material, and includes a brush-like first contact piece 35*a* which slides along the resistor element 15 while being in elastic contact therewith and a brush-like second contact piece 35*b* which slides along the current collector 12*b* while being in elastic contact therewith.

As shown in FIG. 3A, the center hole 31 in the rotating shaft 30 is preferably configured as a partially filled cylindrical hole. When an operation shaft (not shown) is inserted into the center hole 31 and rotated rightward or leftward, the rotating shaft 30 and the slider 35 rotate together so as to vary the contact locations at which the contact pieces 35*a* and 35*b* are in contact with the resistor element 15 and the current collector 12*b*, respectively. Accordingly, the lengths of the resistor element 15 and the current collector 12*b* also vary, and thus, the resistance between the terminals 12 and 13 is adjusted.

Next, the conductive elements 43 will be described. The structure of the conductive elements 43 is similar to that of the conductive elements 53 according to the first preferred embodiment. Each conductive element 43 includes the exposed portion 13*b* of the corresponding terminal 13 and an electrode film 44 which is electrically connected to the exposed portion 13*b* and which extends along a direction X in which the resistor element 15 extends (see FIG. 6). Each electrode film 44 is covered by an insulator film 45 such that an exposed portion 44*a* of the electrode film 44 is left uncovered.

Figure 7B:
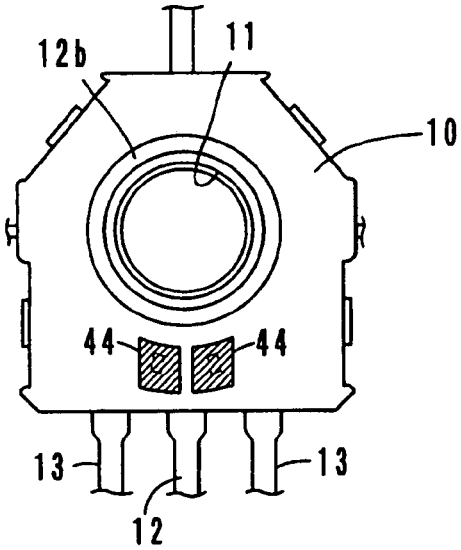
FIG. 7B is a diagram showing an electrode-film-forming step in the manufacturing process.

The conductive elements 43 are formed by the following steps. First, as shown in FIG. 7A, the substrate member 10 is formed by resin molding on the hoop material 40, which includes the terminals 12 and 13 obtained by the punching process, such that the exposed portions 13*b* of the terminals 13 face outward on the surface of the substrate member 10. Then, as shown in FIG. 7B, the electrode films 44 (shown as hatched areas in FIG. 7B) are individually formed on the surface of the substrate member 10 such that the electrode films 44 cover the exposed portions 13*b* of the respective terminals 13 and are electrically connected to the exposed portions 13*b*.

Figure 5:
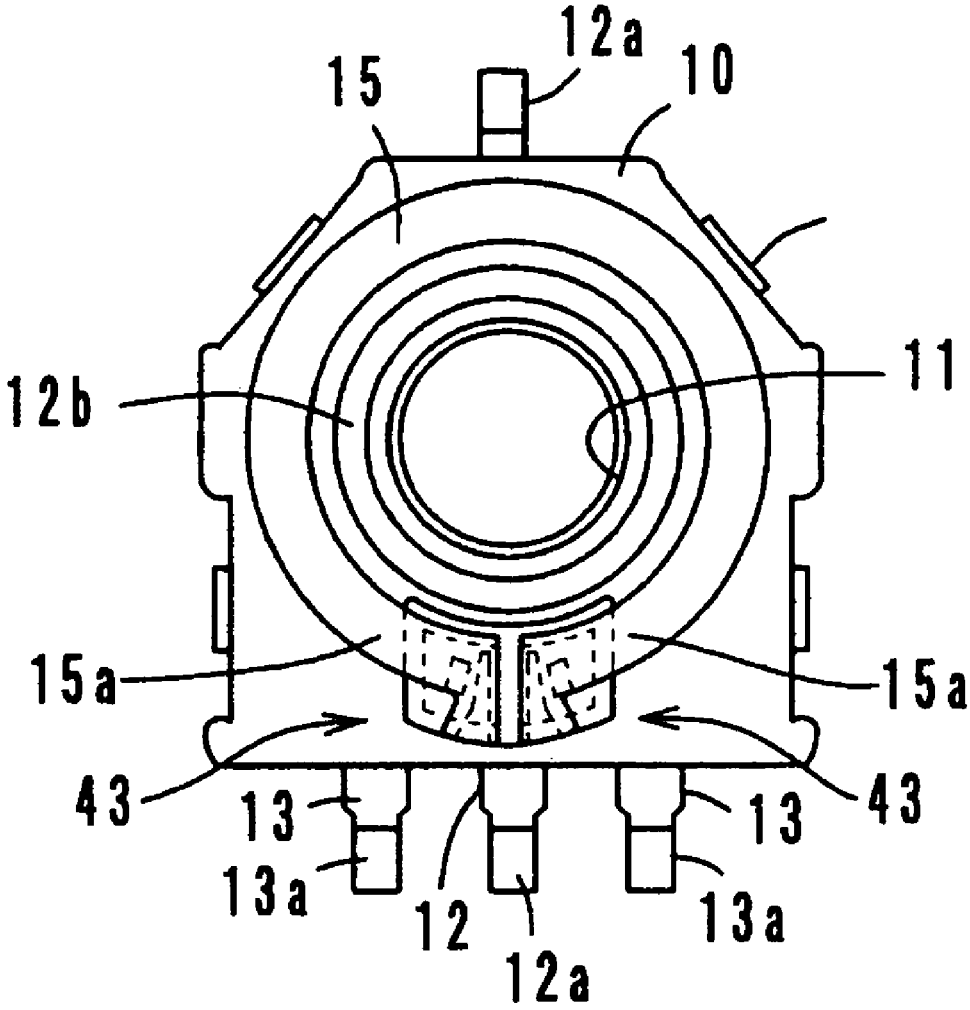
FIG. 5 is a plan view showing a complete substrate included in the variable resistor.
Figure 6:
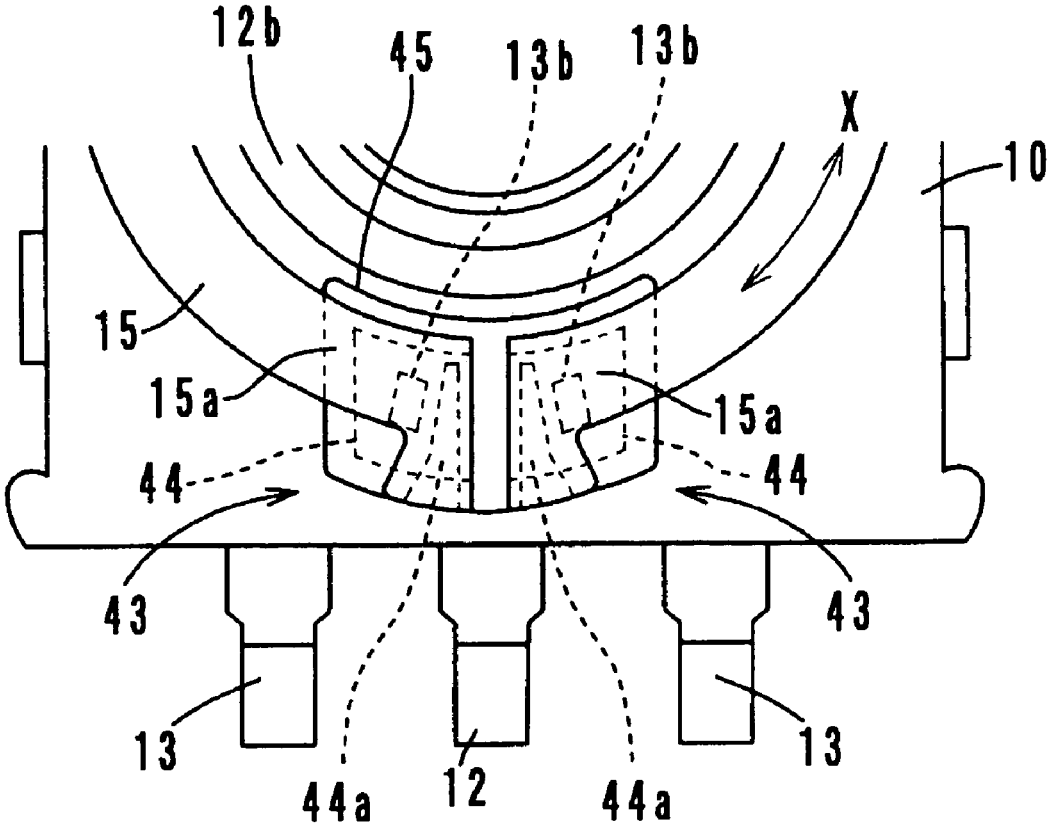
FIG. 6 is an enlarged view of a portion of FIG. 5.
Figure 7C:
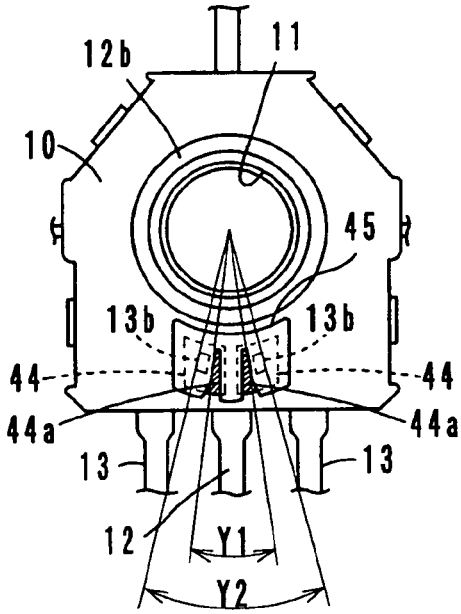
FIG. 7C is a diagram showing an insulator-film-forming step in the manufacturing process.
Figure 8:
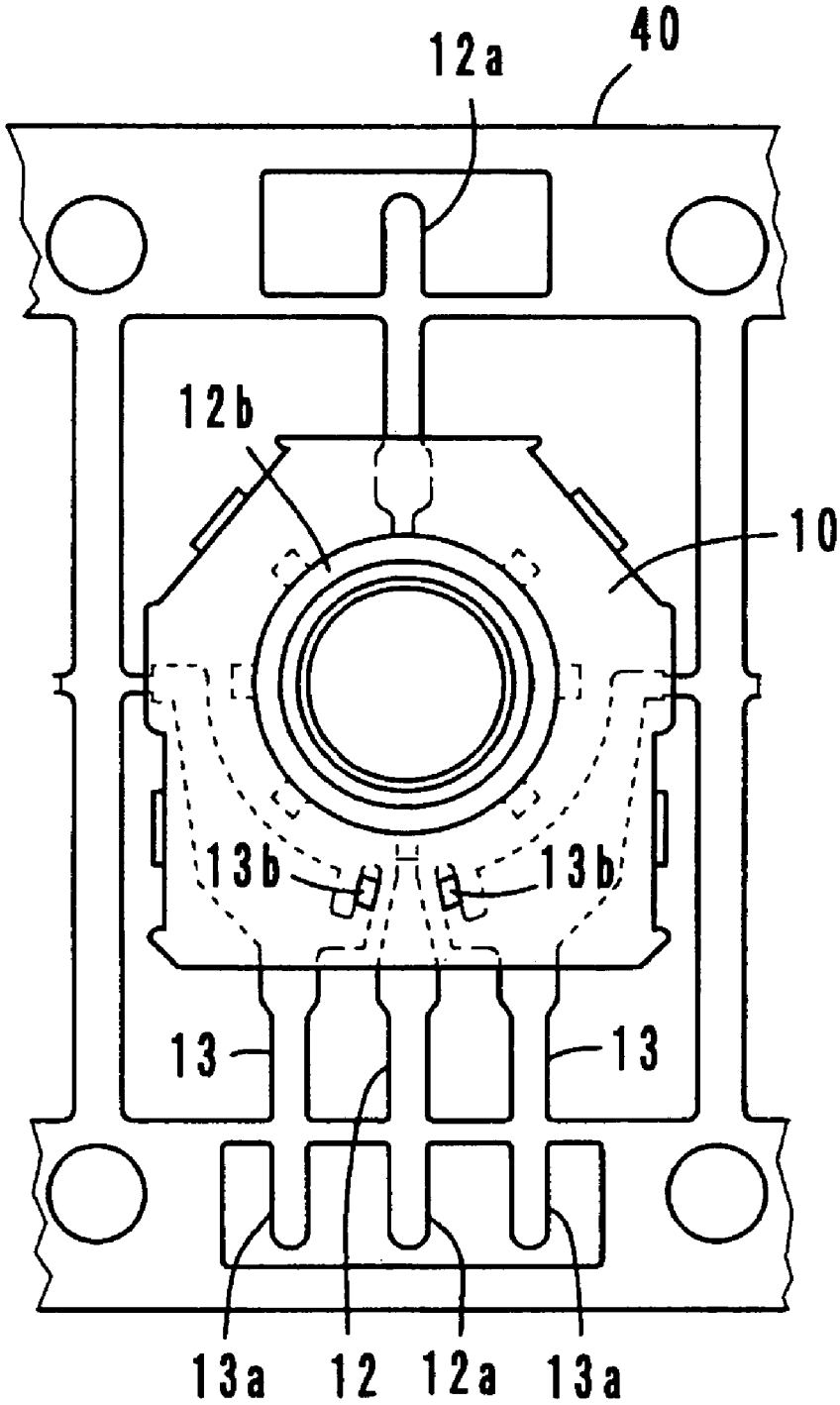
FIG. 8 PRIOR ART
FIG. 8 is a plan view showing a substrate-molding step in a process of manufacturing a known variable resistor.
Figure 9:
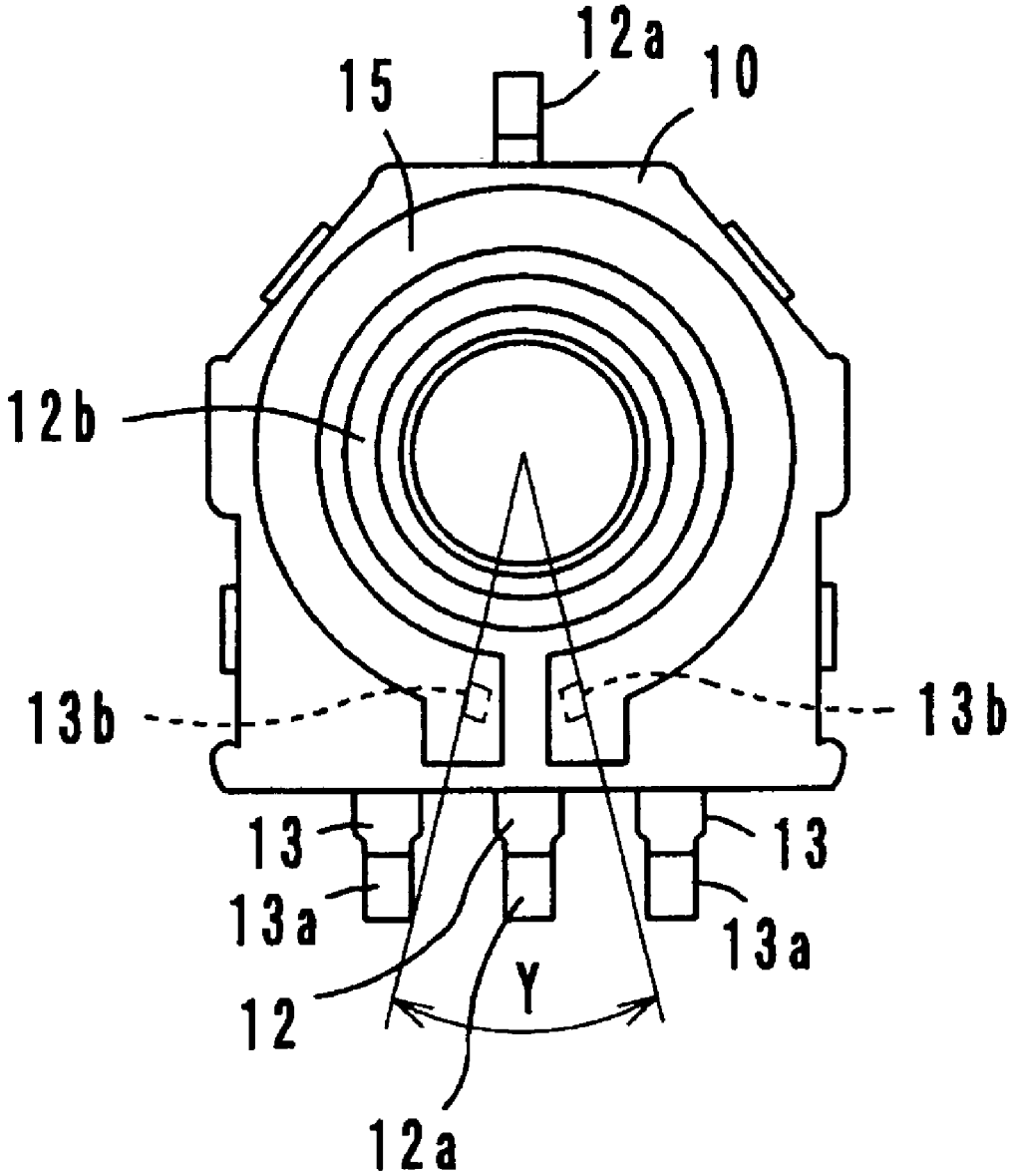
FIG. 9 PRIOR ART
FIG. 9 is a plan view showing a complete substrate included in the known variable resistor.

Then, as shown in FIG. 7C, the electrode films 44 are covered by the insulator film 45 such that the exposed portions 44*a* (shown as hatched areas in FIG. 7C) of the electrode films 44 face outward. Then, the resistor element 15 is formed on the surface of the substrate member 10 such that the end portions 15*a* of the resistor element 15 are electrically connected to the terminals 13 via the conductive elements 43, as shown in FIG. 5. More specifically, the end portions 15*a* of the resistor element 15 are electrically connected to the exposed portions 44*a* of the respective electrode films 44, and are thereby electrically connected to the terminals 13 via the electrode films 44.

In the variable resistor 1, as shown in FIG. 7C, the exposed portions 44*a* are formed inside the exposed portions 13*b* of the terminals 13, and a variable resistance range corresponds to the length of the resistor element 15 excluding an area corresponding to an angle Y1 between the exposed portions 44*a*. The angle Y1 refers to a maximum angle between lines extending from the center of the resistor element 15 through the exposed portions 44*a*, that is, an angle between lines extending through the outermost locations of the exposed portions 44*a*.

The exposed portions 44*a* may also be formed outside the exposed portions 13*b* of the terminals 13. In such a case, the variable resistance range corresponds to the length of the resistor element 15 excluding an area corresponding to an angle Y2 between the exposed portions 13*b*. The angle Y2 refers to a maximum angle between lines extending from the center of the resistor element 15 through the end portions 13*b*, that is, an angle between lines extending through the outermost locations of the end portions 13*b*. The variable resistance range can be increased by setting the angle Y1 to be less than Y2.

More specifically, in the variable resistor 1, the variable resistance range can be increased or varied without changing the locations and shapes of the terminals 13 by simply changing the locations of the exposed portions 44*a*, with which the resistor element 15 comes into contact, in the process of forming the insulator film 45.

In addition, in the variable resistor 1 according to the second preferred embodiment, even though the terminal 12 is located between the terminals 13, the length of the substantially annular resistor element 15 can be increased by setting the angle Y1 to be less than the angle Y2, as described above. Accordingly, the variable resistance range can be increased.

In the second preferred embodiment, the electrode films 44 and the insulator film 45 are made of the same materials as those used in the first preferred embodiment. However, the present invention is not limited to this. In addition, the resistor element 15 and other components are made of materials similar to those used in the known structure.

The resistance substrate and the variable resistor according to the present invention are not limited to the above-described preferred embodiments, and various modifications are possible within the scope of the present invention. For example, detailed structures and shapes of the substrate member, the resistor element, the slider, and the current collector may be determined arbitrarily.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. A resistance substrate comprising:

a substrate member;

two conductive elements provided on the substrate member; and a resistor element provided on the substrate member, the resistor element electrically connecting the conductive elements to each other; wherein each of the conductive elements includes an exposed portion of a metal terminal and an electrode, the exposed portion of the metal terminal being exposed on a surface of the substrate member and the electrode being electrically connected to the exposed portion and extending along a direction in which the resistor element extends;

each of the conductive elements is covered by an insulator film such that an exposed portion of the electrode is left uncovered;

the resistor element is electrically connected to the exposed portions of the electrodes at both ends thereof; and the insulator film is disposed between a lower surface of the resistor element and an upper surface of each of the electrodes of the conductive elements.

2. A variable resistor comprising:

the resistance substrate according to claim 1; and a slider arranged to be slidable along a surface of the resistor element.

3. The variable resistor according to claim 2, wherein the resistor element has a substantially annular shape with a cutout portion.

4. The variable resistor according to claim 3, wherein a maximum angle between lines extending from the center of the resistor element through the exposed portions of the electrodes is less than a maximum angle between lines extending from the center of the resistor element through the exposed portions of the metal terminals in a region including the cutout portion.

5. The resistance substrate according to claim 1, wherein the resistor element is made of a conductive resin material.

6. The resistance substrate according to claim 1, wherein the insulator film is made of phenolic or epoxy thermosetting resin material.

7. The resistance substrate according to claim 1, wherein the electrodes are electrode films made of phenolic or epoxy thermosetting resin material including conductive material.

8. The variable resistor according to claim 2, wherein the substrate member includes first and second terminals embedded therein.

9. The variable resistor according to claim 8, wherein the first terminal includes a terminal portion projecting from a side surface of the substrate member and an annular current collector disposed in a central portion of the substrate member.

10. The variable resistor according to claim 8, wherein the second terminal includes a terminal portion projecting from a side surface of the substrate member and an exposed portion which is exposed on a major surface of the substrate member.

11. The variable resistor according to claim 2, wherein the slider includes a central hole, and a shaft is disposed in the central hole such that the slider turns when the shaft is turned.

12. The variable resistor according to claim 3, wherein the slider has a substantially annular shape, and the slider and the resistance element are arranged substantially concentrically.

13. The variable resistor according to claim 1, wherein the insulator film is disposed directly on substantially the entire upper surface of each of the electrodes except at the exposed portions at which the resistor element is electrically connected to the electrodes.

* * * * *